US006035572A

United States Patent [19]

Goode, Jr.

[11] Patent Number: 6,035,572

[45] Date of Patent: Mar. 14, 2000

[54] COMBINATION GUN REST, STOOL AND WADING STICK

[76] Inventor: Lloyd O. Goode, Jr., 3525 Edencroft Dr., Raleigh, N.C. 27612

[21] Appl. No.: 09/109,337

[22] Filed: Jun. 30, 1998

[51] Int. Cl.[7] ..... F41A 27/30

[52] U.S. Cl. ..... 42/94

[58] Field of Search ..... 211/64; 42/94

[56] References Cited

U.S. PATENT DOCUMENTS

| | | | |
|---|---|---|---|
| D. 182,146 | 2/1958 | Sharp | D30/1 |
| 3,007,581 | 11/1961 | Moore | 42/94 |
| 3,283,733 | 11/1966 | Boerma | 248/156 |
| 3,467,033 | 9/1969 | Sienkiewicz et al. | 248/156 |
| 3,584,821 | 6/1971 | Gleb | 248/410 |
| 3,817,483 | 6/1974 | Garvey | 248/155 |
| 3,910,382 | 10/1975 | Justice | 42/94 |
| 4,089,423 | 5/1978 | Gorham et al. | 211/64 |
| 4,854,066 | 8/1989 | Cantebury, Sr. | 42/94 |
| 4,882,869 | 11/1989 | Webster | 42/94 |
| 5,410,835 | 5/1995 | Vetter | 42/94 |
| 5,680,939 | 10/1997 | Oliver | 211/64 |
| 5,715,625 | 2/1998 | West, III | 42/94 |
| 5,913,667 | 6/1999 | Smilee | 42/94 |

*Primary Examiner*—Charles T. Jordan
*Assistant Examiner*—Denise J Buckley
*Attorney, Agent, or Firm*—Mills Law Firm PLLC

[57] ABSTRACT

A combination gun rest, pivoting hunting stool, and wading stick device particularly for use by duck hunting enthusiasts is disclosed. This multi-function apparatus includes a ground-engaging gun rest which independently supports a shot gun or rifle in a generally upright position. A duck hunter's stool including a cross-shaped base support with a ground-engaging member and a detachable seat member provide the hunter with a 360° field of view from a seated position. The seat member is provided with suitable hardware to permit it to be stored on the tubular support member of the stool. The gun support is inserted within the tubular support member of the stool and locked in position such that the entire assembly functions as a wading stick to assist the hunter in maintaining balance when walking through a wetland or shallow water environment. The present device is lightweight and compact for convenient transport and storage.

5 Claims, 2 Drawing Sheets

COMBINATION GUN REST, STOOL AND WADING STICK

BACKGROUND OF INVENTION

Field of Invention

This invention relates generally to combination gun rests and sports seats, and more particularly, to a combination gun rest, duck hunting stool, and wading stick.

In the sport of duck hunting it is often necessary for the hunter to travel remote areas which are inaccessible by motor vehicles. Accordingly, the duck hunter must wear or hand carry the necessary equipment such as water proof clothing, shot gun and ammunition, gun rest, and related essentials. Because the duck hunter's realm is typically an aquatic environment, special consideration must be given to keeping the hunter reasonably comfortable and the equipment clean and dry.

Thus, various specialized devices have been developed to meet the needs of the hunter in the field. For example, U.S. Pat. No. 3,007,581 discloses a duck hunter's crutch including an adjustable, ground engageable gun rest which may also be used by the hunter in the manner of a crutch to assist in walking through wetland areas. However, such a device does not provide the hunter with a seat in which to rest nor does it function as a useful wading stick.

U.S. Pat. No. 5,715,625 discloses a portable shooter's bench which includes a seat carried by a pivotable leg assembly and from which assembly a firearm support rest is adjustably mounted. Although this device does include a seat for the hunter, it does not function as a walking or wading stick. Further, the gun support rest portion is not designed to independently support the weapon but merely to steady the hunter's position when shooting.

Thus, the combination gun rest, duck hunting stool, and wading stick of the present invention has been developed to provide the duck hunter with each of the above functions in a single device.

DESCRIPTION OF RELATED PRIOR ART

U.S. Pat. No. 3,817,483 to Francis J. Garvey discloses a combination sports seat and walking stick including a staff or leg member and a seat member hinged at its mid point to one end of the staff. The seat member is foldable from an operative position normal to the staff or to a retracted, inoperative position along the staff for use of the device as a cane or walking stick. However, this device does not provide a gun rest function.

U.S. Pat. No. 3,007,581 to Benjamin F. Moore discloses a duck hunter's crutch including a telescopically adjustable, ground engaging gun rest which is constructed generally in the manner of the conventional walking crutch to provide the hunter with a walking stick in the field. However, the crutch provides no stop means at the ground engaging end to prevent it from sinking into marshy soil.

U.S. Pat. No. 5,680,939 to John W. Oliver discloses a ground engageable gun support including a main ground engaging tube and an adjustable elongated tube slideably attached to the main elongated tube by a pair of stabilizing bars with a gun butt support tray at the lower end of the elongated tube and a generally Y-shaped barrel support bracket attached at the upper end of the adjustable tube to receive support of the butt and barrel of the gun. However, this device is not intended to serve as a walking stick nor does it provide a seat for the hunter.

U.S. Pat. No. 5,410,835 to W. Moray Vetter discloses a firearm bipod support for a firearm including a first strut and a second strut angularly related to each with one of the struts having an elongated projection serving as the rest for the barrel of the rifle or pistol when the two struts are positioned upright on the ground. However, this device is intended to steady a weapon held in a shooting position and does not independently support the weapon. Further, it clearly does not provide a seat for the user.

U.S. Pat. No. 3,584,821 to George T. Glebe discloses a firearm support for steadying a firearm during field and target shooting including a pointed, ground engaging shaft having a firearm support member slideably mounted thereon. A handgrip and a special locking device lock the support member in a raised position. Although this device could conceivably be used as a walking stick, it does not provide a stop means to function as a usefull wading stick nor does it independently support a weapon. Further, there is no seat provided for the user.

U.S. Pat. No. 5,715,625 to David T. West, III discloses a portable shooter's bench which includes a seat carried by a pivotal leg assembly from which a firearm support rest is adjustably mounted. The seat functions as a carrying handle and the bench automatically folds when lifted. However, this device is not intended to independently support a gun but merely to steady the shooter's aim in a seated position. Clearly, this device does not provide the added function of a wading stick.

U.S. Pat. No. 3,283,733 to John C. Boerma discloses a portable and collapsible sportsman's seat which is intended to support the user in a seated position and to permit pivoting movement while seated. However, this device does not function as a gun rest or a wading stick in the field.

U.S. Pat. No. 3,467,033 to Marvin M. Sienkiewicz et al. discloses a folding stool including an elongated supporting member that attaches to a generally rectangular seat member. However, this device is not intended for use as a gun support or a wading stick.

Finally, U.S. Pat. No. DES. 182,146 discloses the ornamental design for a gun rest having an elongated, pointed, ground engaging member with a gun supporting member attached thereto. Although this device could conceivably serve as a walking stick in the field, it does not provide a usefull wading stick for marshy soils. Further, this type of gun rest is intended to steady the weapon when shooting and not to independently support the weapon.

SUMMARY OF THE INVENTION

After much study of the prior art devices, the present invention has been developed to provide a combination gun rest, hunting stool and wading stick particularly for duck hunting enthusiasts. The combination device of the present invention provides the user with a ground engaging gun rest for shot gun, a pivoting stool to permit the hunter to change his position without standing, and a wading stick to assist the hunter in walking through marshland areas.

The combination device of the present invention can be assembled into a single, easy-to-carry unit which can be conveniently grasped and manipulated in a single hand.

The combination device is fabricated from readily available materials and can be assembled by a user of ordinary mechanical skills.

In view of the above, it is an object of the present invention to provide a combination gun rest, duck hunting stool, and wading stick designed particularly for duck hunting enthusiasts, but that can be adapted to any of the hunting sports which utilize a long rifle.

Another object of the present invention is to provide a ground-engaging gun rest which will independently support a shot gun or rifle in a generally vertical position.

Another object of the present invention is to provide a ground-engaging gun rest which will also support a gunning accessory bag and game stringer if desired.

Another object of the present invention is to provide a ground-engaging gun rest having a horizontal stop means affixed thereto to provide upright stability and to resist forward and backward movement once it is deployed.

Another object of the present invention is to provide a pivoting stool which will permit the hunter or other user to obtain a 360° field of view without standing up.

Another object of the present invention is to provide the user with a wading stick to balance the user when walking through marshlands and other aquatic environments.

Another object of the present invention is to provide a combination gun rest, hunting stool, and wading stick which can be assembled into a single, easy-to-carry unit that can be grasped and manipulated by a single hand.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
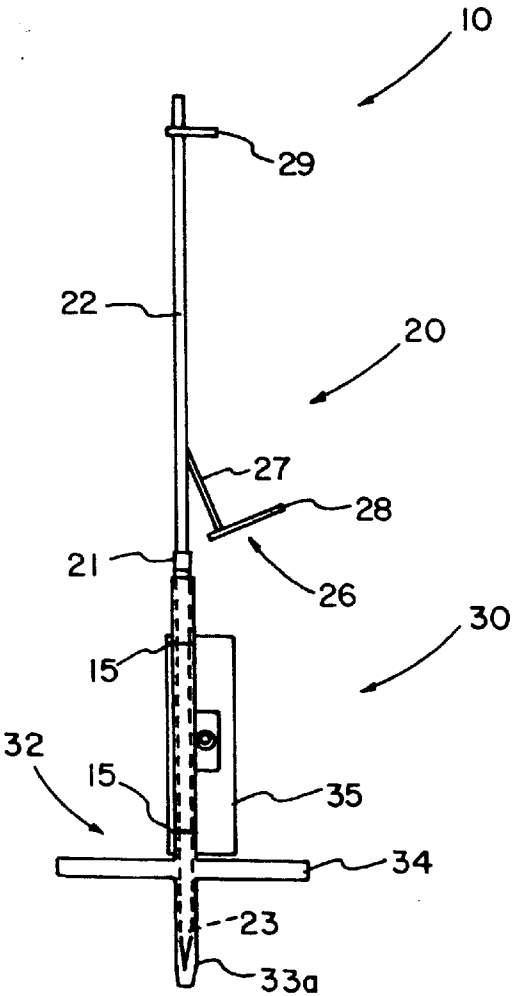
FIG. 1 is a side elevational view of the combination gun rest, stool and wading stick of the present invention in an assembled condition.

With further reference to the drawings there is shown therein a combination gun rest, hunting stool, and wading stick in accordance with the present invention indicated generally at 10 and illustrated in FIG. 1.

In the preferred embodiment combination device 10 includes a gun rest, indicated generally at 20 and a stool, indicated generally at 30 including a seat member 35 and base support, indicated generally at 32. It will be appreciated that the device 10 in the assembled configuration shown in FIG. 1 serves as a wading stick for the user as described hereinafter in further detail.

Figure 2:
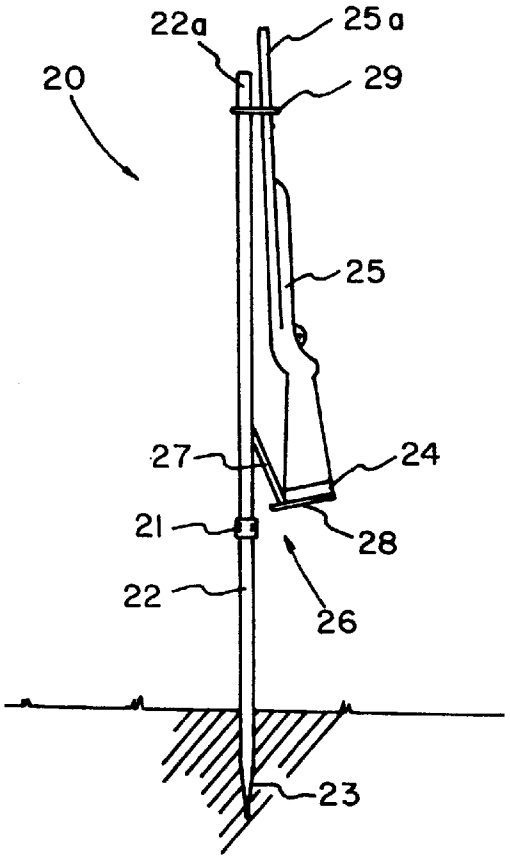
FIG. 2 is a side elevational view of the gun rest component with a shot gun mounted thereon.

Referring now to FIG. 2 the gun rest 20 of the present invention is illustrated as removed from the combination device 10. The gun rest 20 includes an elongated shaft 22 which terminates at the lower end thereof in a tapered point 23 which functions to engage the ground surface 24 to position the gun rest 20 in an upright position.

The gun rest 20 includes a generally L-shaped butt support bracket, indicated generally at 26 having a long leg member 27 and a short leg member 28 disposed in perpendicular relation thereto. The long leg member 27 is disposed at an acute angle relative to an axis of the shaft 22 being fixedly attached thereto by weldment or other suitable fastening means.

In this configuration, the short leg member 28 is disposed at a predetermined angle to receive the butt plate 24 of a conventional shot gun 25 as shown in FIG. 2.

In the preferred embodiment the short leg member 28 is generally V-shaped in cross section having downwardly converging side members (not shown) to better secure the butt plate 24 of the shot gun 25.

The upper end 22*a* of the shaft 22 is provided with a generally U-shaped bracket 29 which is fixedly attached in perpendicular relation to the shaft 22 to engage and support the barrel portion 25*a* of the shotgun 25.

In addition to supporting the barrel portion 25*a* of the shotgun, the bracket 29 functions as a convenient hanger for a gunning accessory bag (not shown) and related gear which must be carried by the hunter in the field.

It will be noted that the butt support bracket 26 is disposed at a predetermined dimension from the point 23 of the shaft 22 such that once the point 23 is engaged below ground level as shown in FIG. 2, a conventional shot gun 25 can be supported well above the moisture-laden, wetlands frequented by duck hunters.

In the preferred embodiment the bracket 26 will position the butt plate 24 of the shotgun 25 at approximately the same vertical height as the seat member of the stool 30 as described hereinafter in further detail.

Figure 3:
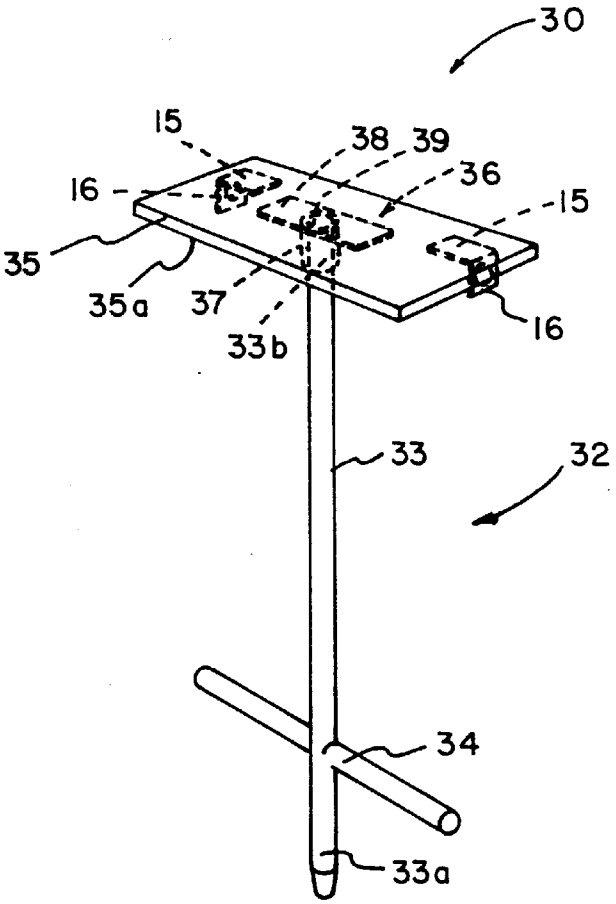
FIG. 3 is a perspective view of the stool component of the present invention.

Referring now to FIG. 3 there is shown therein a pivoting stool 30 in accordance with the present invention. The stool 30 includes a seat member 35 which is pivotally attached to a base support, indicated generally at 32. The base support 32 further includes an upright tubular member 33 having a ground-engaging portion 33*a* and being disposed in perpendicular relation to an cross-shaped foot member 34.

In the preferred embodiment the base support 32 is a unitary, tubular construction being fabricated of a molded plastic material such as aluminum or polyvinyl chloride (PVC) having suitable physical and mechanical properties.

As shown in phantom outline in FIG. 3 the seat member 35 is provided with a T-shaped bearing support bracket, indicated generally at 36, including a bearing cup 37 that is attached in perpendicular relation to a bearing plate 38 secured to the underside 35*a* of the seat member 35 by suitable attaching hardware.

It will be appreciated by those skilled in the art that in this arrangement the bearing cup 37 is placed over the upper end 33*b* of the tubular upright member 33 so as to impart the seat member 35 with 360° rotation about the axis of the upright member 33.

In this manner a duck hunter or other user may set up the stool 30 at the water's edge and remain seated as incoming water fowl approach the target area. The pivoting movement of the seat allows the hunter to remain in the seated position and to rotate his body about the axis A of the upright member 33 while holding the shot gun 25 in a shooting position.

It will be noted that cross-shaped foot member 34 disperses the downward pressure of the hunter's body weight and thereby prevents the stool 30 from sinking into the marshy soils typically encountered by the duck hunter in wetlands. The cross-shaped configuration of the foot member 34 also imparts stability to the stool 30 once the ground engaging portion 33*a* penetrates the soil.

The seat member 35 also includes a pair of right-angled retaining brackets 15 which are fixedly attached to the underside 35*a* of seat member 35 by suitable attaching hardware. The retaining brackets 15 include a mounting aperture 16 having a diameter slightly larger than the upright member 33 of the base support permitting the seat member 35 to be stored in the position shown in FIG. 1 by inserting the upright member 33 through each mounting aperture 16 and sliding the seat member downwardly into contact with the foot member 34.

Thereafter, with the seat member 35 stowed as described hereinabove, the gun rest 20 is simply withdrawn from the ground and inserted into the central opening 39 of the upright member 33 to the position shown in FIG. 1.

In the embodiment shown in FIG. 1 the gun rest 20 is provided with a threaded coupling 21 which engages a mating thread formed at the upper end 33*a* of the upright member 33 to secure the gun rest 20 to the base support 32.

Of course, various coupling means could be devised for this purpose and, thus, the embodiment described herein is intended as illustrative and not restrictive in any sense.

Figure 4:
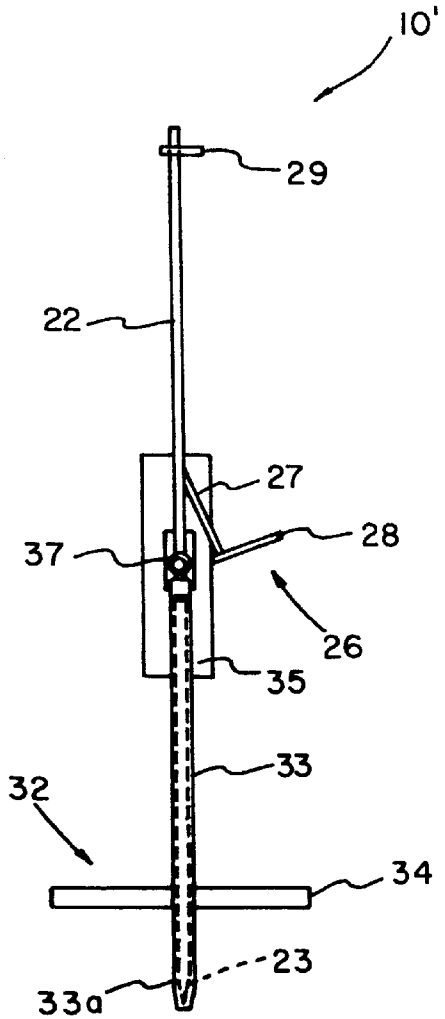
FIG. 4 is a side elevational view of an alternative embodiment of the combination gun rest, stool and wading stick of the present invention in an assembled condition.

In an alternative embodiment shown in FIG. 4 and indicated generally at 10', a pair of coaxial holes 31 having a diameter slightly larger than the shaft 22 are drilled through the side walls of the bearing cup 37 in perpendicular relation thereto. In this version it will be seen that the retaining brackets 15 have been eliminated.

Thus, in an assembly procedure for this embodiment, the tapered point 23 of the shaft 22 slidingly engages the holes 31 and the seat member 35 is retained on the shaft 22.

Thereafter, the tapered point 23 is axially inserted into the upright member 33 to the position shown in FIG. 4.

It will be appreciated that in the configurations shown in FIGS. 1 and 4, the present invention functions effectively as a wading stick for the duck hunter or other user which can be grasped in a single hand and utilized to maintain balance when walking through marshlands and swampy areas. The tapered tip of the ground-engaging member 33*a* may be submerged in water to engage the muddy bottom surface to provide a handhold for the user. The cross-shaped foot member 34 prevents the ground-engaging member 33*a* from entering too deeply into the muddy bottom of the marsh thereby making it easily withdrawn as the user walks forwardly and again re-submerges the member 33*a* to engage the bottom surface. The cross-shaped foot member 34 also tends to maintain the device 10 in a generally vertical condition thereby assisting the user in maintaining his balance in the marshy terrain.

Upon arrival at a desired location, the device 10 is easily disassembled and may be deployed as often as desired during the course of the hunting activity. To make the assembled device easier to carry when it is not in active use, an elastic cord or so-called bungie cord (not shown) may be easily attached to various points on the device and utilized in the manner of a shoulder strap for convenient transport.

From the above, it can be seen that the combination gun rest, hunting stool, and wading stick of the present invention provides a multi-function tool for the sportsman and, more particularly, for the duck hunting enthusiast.

The combination device provides a gun rest which will independently support a shot gun in a vertical position for convenient access by the hunter who can remain seated in the pivoting stool while waiting for incoming water fowl. The pivoting stool allows the hunter a 360° field of view while remaining seated in a ready-to-shoot position. The gun rest also serves as a convenient rack for hanging a gunning accessory bag and other related items.

The combination device can be assembled into a compact wading stick which is utilized by the hunter when traveling to and from the duck hunting site through marshy areas.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A combination gun rest, hunting stool, and wading stick device comprising:

a gun supporting means including an elongated, ground-engaging shaft having a gun butt support bracket and a gun barrel support bracket fixedly attached thereto in predetermined locations;

a pivoting stool means including a base support structure having an cross-shaped foot member with an upwardly projecting tubular member attached thereto, said tubular member being adapted for pivoting engagement with a seat member imparting 360° pivoting movement to said seat member; and a wading stick means formed by mounting the stool means on the shaft of the gun support means and axially connecting said gun supporting means to said tubular member whereby a user can partially submerge said device in shallow waters to maintain balance when said user is walking through a wetland environment.

2. The combination device of claim 1 wherein said gun supporting means is capable of independently supporting a shot gun in a generally vertical position.

3. The combination device of claim 2 wherein said shot gun is supported at a predetermined vertical distance above ground level.

4. The combination device of claim 1 wherein said seat member includes a bearing support bracket attached thereto, said bracket being configured to detachably receive said tubular member therein in pivoting relation thereto.

5. The combination device of claim 4 wherein said seat member further includes a pair of retaining brackets attached thereto, said retaining brackets each including a mounting aperture formed therein, said brackets being positioned on said seat member such that said apertures are disposed in coaxial relation, said brackets being configured to slideably engage said tubular member for storage of said seat member thereon.

* * * * *